US008927844B2

(12) United States Patent
Kitching

(10) Patent No.: US 8,927,844 B2
(45) Date of Patent: Jan. 6, 2015

(54) DRUM PEDAL

(71) Applicant: Alan Kitching, Edinburgh (GB)

(72) Inventor: Alan Kitching, Edinburgh (GB)

( * ) Notice: Subject to any disclaimer, the term of this patent is extended or adjusted under 35 U.S.C. 154(b) by 0 days.

(21) Appl. No.: 14/042,281

(22) Filed: Sep. 30, 2013

(65) Prior Publication Data

US 2014/0090543 A1 Apr. 3, 2014

(30) Foreign Application Priority Data

Sep. 29, 2012 (GB) ..... 1217465.2

(51) Int. Cl.
*G10D 13/02* (2006.01)
*G10D 13/00* (2006.01)

(52) U.S. Cl.
CPC ..... *G10D 13/006* (2013.01)
USPC ..... 84/422.1

(58) Field of Classification Search
CPC ..... G10D 13/006
See application file for complete search history.

(56) References Cited

U.S. PATENT DOCUMENTS

| | | | | | |
|---|---|---|---|---|---|
| 2,484,302 | A * | 10/1949 | Laverents | ..... | 84/422.1 |
| 2,800,828 | A * | 7/1957 | Moeller | ..... | 84/422.1 |
| 6,417,433 | B1 * | 7/2002 | Milla et al. | ..... | 84/422.1 |
| 6,593,518 | B2 * | 7/2003 | Hsieh | ..... | 84/422.1 |
| 6,710,237 | B2 * | 3/2004 | Adams | ..... | 84/422.1 |
| 7,368,650 | B2 * | 5/2008 | Hsieh | ..... | 84/422.1 |
| 2014/0090543 | A1 * | 4/2014 | Kitching | ..... | 84/422.1 |

* cited by examiner

*Primary Examiner* — Robert W Horn
(74) *Attorney, Agent, or Firm* — Berliner & Associates

(57) ABSTRACT

A footplate for a drum pedal having a forefoot contact-receiving portion, a heel contact-receiving portion and a fulcrum about which a user's foot may pivot between contacting the heel and forefoot contact-receiving portions provides a configuration for enhanced and effective dual beat or heel-toe drumming technique. In use, a drummer's heel may hit the footplate at an aft portion providing a dedicated heel contact area of the footplate, which causes the drum pedal beater to make a first beat against a drum whilst the drummer's foot rocks forward across the fulcrum to make contact with an upper or fore portion of the returning footplate in turn propelling the beater to strike the drum for a second time. This enables improved control, repeatability and reliability of the "heel-toe" technique producing greater consistency in the volume and sound of both heel and toe driven beats.

20 Claims, 16 Drawing Sheets

DRUM PEDAL

This invention relates to musical instruments, more specifically, the invention is directed to a drum pedal providing a means for both the heel and upper part of the operator's foot to independently propel a single beater to strike a drum.

When a musical group perform, they may use many different types of pedals to trigger both electronic and acoustic sounds. Pedals are particularly useful to a drummer in a group such that are usually used as a trigger mechanism to close and open hi-hat cymbals or propel a beater to strike a drum.

There are a variety of such pedals on the market. The most common basic components of a drum pedal comprise of a frame supporting a sprung loaded axel, a beater attached to the axel via a sprocket or cam or wheel or similar device, and a hinging footplate which is attached to the sprocket or cam or wheel via a chain, link or strap. When the foot plate is depressed the chain or strap pulls on the sprocket or wheel rotating the axel and propelling the beater to strike a drum. It should be noted that although there are currently various different designs, shapes and sizes of drum pedal their basic operation can relate to the above basic description. The footplates of these pedals are inherently flat in profile.

Over the years drummers have developed a specialised "heel-toe" technique to enable them to create quick successive beats on a single drum using such a pedal. This "heel-toe" technique involves the drummer applying first a downwards force using their heel to depress the footplate propelling the beater to strike the drum and then quickly rocking their foot so that when the returning footplate comes into contact with their toes or ball of their foot the footplate is depressed again propelling the beater to strike the drum for a second time. In general this "heel-toe" rocking motion requires less effort and produces quicker successive beats than trying to depress the footplate quickly in succession just using the toes or ball of the foot. The "heel-toe" technique can take considerable time to master due to the accuracy of angle a drummer must first contact the footplate with their heel and thereafter the rocking motion of the foot has to be accurately controlled to release the footplate correctly to enable the toes or ball of their foot to positively depress the footplate for a second time.

In order to address this issue one manufacture has invented a pedal whereby depressing the heel on one footplate propels one beater and the toes or ball of the foot depresses a second footplate to propel a second beater. Problems can arise when two beaters are used on a single drum if the first beater to strike the drum remains at rest against the head of the drum when the second beater strikes, the sound of the second strike being somewhat dampened because the first beater prevents the drum head from resonating fully. In addition the force of the second beater striking the drum can bounce the first beater momentarily against the drum head creating a quieter, uncontrolled and undesirable third beat.

The present inventor has devised a footplate and drum pedal assembly that allows the amateur and professional drummer alike to readily achieve the heel-toe drumming technique whilst overcoming the problems with the prior art.

Accordingly, in a first aspect of the invention, there is provided a footplate for a drum pedal, the footplate comprising a forefoot contact-receiving portion, a heel contact-receiving portion and a fulcrum therebetween about which a user's foot may pivot between contacting respectively the heel and forefoot contact-receiving portions.

In a second aspect of the invention, there is provided a drum pedal assembly comprising: a base plate having mounted thereon a front frame for supporting a drum beater and drive axel and a drum beater supported by the front frame; a footplate pivotally mounted to the base plate at an aft portion of the footplate; and a drive mechanism configured with a fore portion of the footplate and the drum beater so that application of a force against footplate causes pivotal movement of the footplate about the pivotal mounting and causes the drive mechanism to effect propulsion of the drum beater, characterised in that the footplate is as defined above.

In a third aspect of the invention, there is provided a footplate attachment for a footplate for a drum pedal, the footplate attachment comprising a platform bound by at least one edge and a means of permanently or releasably affixing the attachment to a substantially planar footplate for a drum pedal, wherein in use attached to a footplate the platform provides a forefoot contact-receiving surface and the at least one edge, or a striking block provided on the platform, provides a fulcrum about which a user's foot may pivot.

The present invention provides a dedicated and controllable area for a drummer to strike a footplate of a drum pedal with their heel whereby the specific angle of the foot upon contact with the pedal is less critical than in conventional footplates in order to assertively propel the beater forward. The drummer's heel may contact the footplate at an aft portion or at the aft surface of a fulcrum to initiate a propulsion of the beater to strike the drum. A fulcrum provides a means by which, using the "heel-toe" technique, the drummer's foot can then be rocked forward to make contact with an upper or fore portion of the returning footplate, in turn propelling the beater to strike the drum for a second time. Thus, the footplate and drum pedal of the present invention provides an advantageous means by which all drummers can readily apply the heel-toe or dual-beat technique of drumming simply and effectively. By offering the drummer a dedicated and controllable area for their heel to strike the pedal and whereby the required angle of the foot upon contact with the pedal is less critical in order to assertively propel the beater forward, improved control, repeatability and reliability of the "heel-toe" technique is achieved producing greater consistency in the volume and sound of both heel and toe driven beats.

Figure 1:
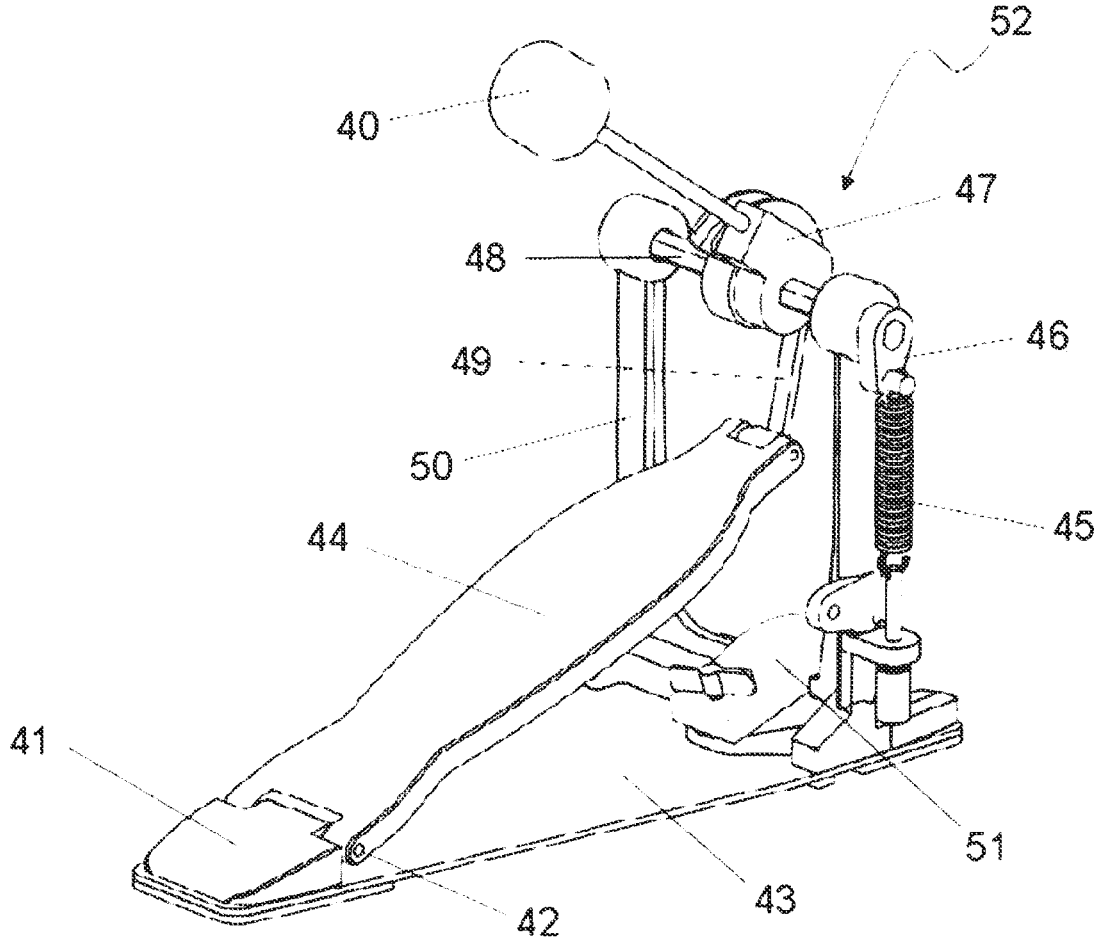
FIG. 1 shows an example of an existing drum pedal with a typically flat footplate and no provision to enable the drummer to easily apply the heel-toe technique to drive the beater to make quick successive beats.
Figure 1A:
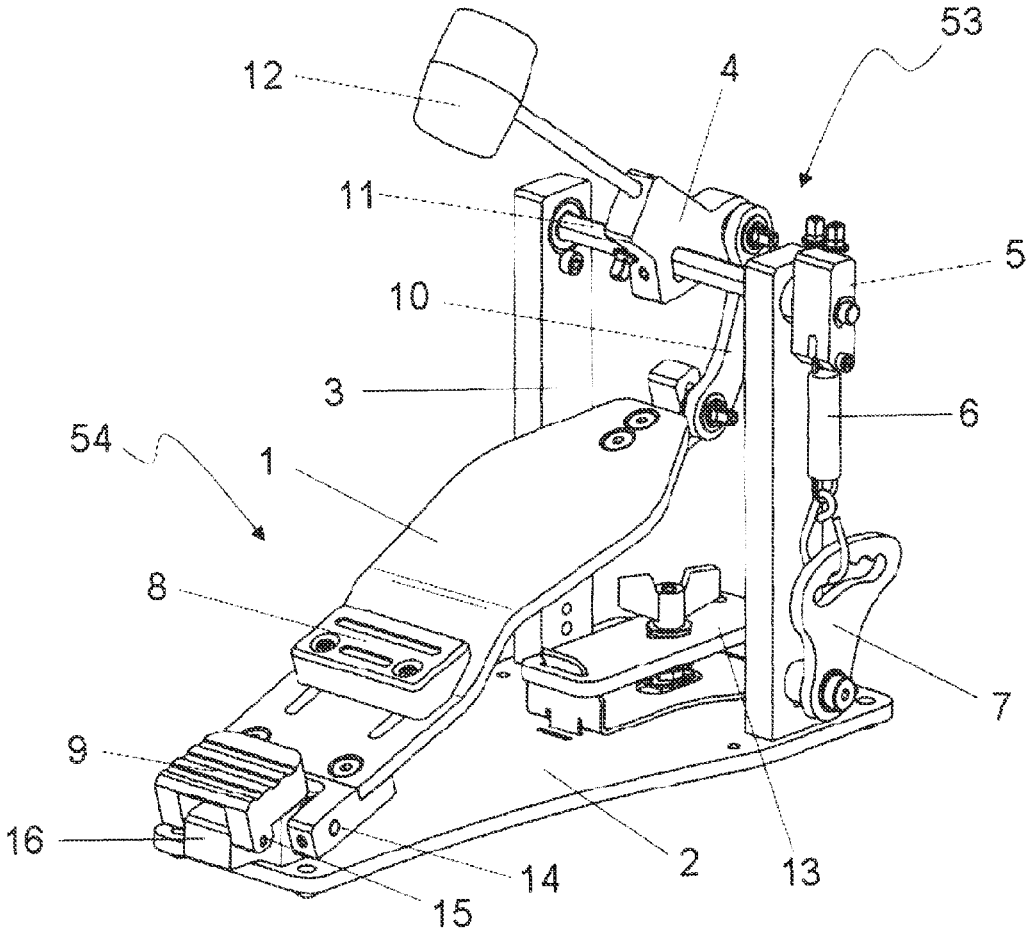
FIG. 1A shows a drum pedal with a joggled footplate with said joggle forming a step, a striking block for the front portion of the drummer's heel, and a heel support block on which the drummer may rest their heel when playing the "heel-down" technique.

The present invention is concerned with drum pedals, drum pedal assemblies and footplates therefore and in particular with providing a means for improved dual beat or heel-toe technique drumming, a technique which is very challenging for beginners and difficult for all to perform consistently. The invention provides a footplate for a drum pedal and a drum pedal assembly comprising the footplate, the footplate comprising a forefoot contact-receiving portion, a heel contact-receiving portion and a fulcrum therebetween about which a user's foot may pivot between contacting respectively the heel and forefoot contact-receiving portions. Thereby, successive applications of force on the heel contact-receiving portion and forefoot contact-receiving portions are capable of causing successive propulsions of a drum beater configured therewith. The provision of a fulcrum about which the user's foot may pivot in order to effect these successive propulsions or beats provides the means by which consistency of drumming can be achieved, since the precise angle of the user's foot when it first strikes the pedal (with the heel) is less critical and the position of the fulcrum provides a guide or striking point to ensure that the relative mechanical advantage (and thus corresponding power and duration) of the first and second strikes are consistent. Thus two discrete applications of force on respectively the heel contact-receiving portion and the forefoot contact-receiving portion may be readily enabled whereby at least two discrete depressions of the footplate may be effected.

A footplate typically has an aft portion configured for pivotal mounting relative to a base plate and a fore portion configured for engagement with a drive mechanism for a beater. In use, a user may typically depress the footplate from its equilibrium position by applying a downward force on at least a portion of the footplate, the depression of the footplate causing the drive mechanism to propel the beater toward a suitably positioned drum. By applying a force to a fore portion of the footplate, i.e. further from the aft-configured pivotal mounting on the base plate, greater mechanical advantage is assumed and less force is required to effect propulsion of the pedal as compared with applying a force to an aft portion of the footplate, i.e. closer to the aft-configured pivotal mounting. Those portions of the footplate the application of force to which may cause propulsion of the beater may be referred to as active portions. When referring to contact-receiving portions or fore and aft portions herein, it is typically intended to refer to active portions unless the context allows or requires otherwise. Optionally, such active portions may be referred to as driveable portions in that they are moveable.

The terms footplate and footboard may be used interchangeably herein.

An aft portion of the footplate may be defined as that portion of the footplate aft of the fulcrum. A fore portion of the footplate may be defined as that portion of the footplate comprising the forefoot contact-receiving portion and being to the fore of the fulcrum.

In one embodiment, the heel contact-receiving portion comprises the aftmost surface of the fulcrum and a void is provided aft of the fulcrum to allow effective contact of a user's heel with the heel contacting portion.

A void may simply, and preferably, be defined as a space associated with the aft portion of the footplate that is such as to allow the user's heel passage to make contact with the heel contact-receiving portion (which is optionally the aft surface of the fulcrum itself). Thus, the void may not itself be materially definable but simply present by virtue of the respective arrangement of fore portion, aft portion and fulcrum. Preferably, a void is that space below the plane (or virtual extension of the plane) of the fore portion of the footplate, which preferably may be the space between at least the surface of an aft portion and the virtually extended plane of the fore portion. Thus the provision of a step or joggle in the footplate may have the effect of providing an offset or 'lowered' aft portion, relative to the fore portion, which arrangement may provide a suitable void.

Preferably, the aft portion of the footplate defines a plane (the aft plane) that is substantially parallel to but offset (in at least a perpendicular direction, but necessarily also the aft portion itself is offset longitudinally from the fore portion) from the plane (the fore plane) of the fore portion. The offset is such that the aft plane is lower than the fore plane thus allowing the user's heel space (a void) through which to strike the heel contact-receiving portion of the footplate. Thus, preferably, the offset of the aft plane from the fore plane (e.g. the surface of a planar aft portion from a surface of a planar fore portion) is of sufficient dimension to allow the user to strike the heel contact-receiving portion (e.g. the aft portion of a fulcrum) and preferably the fulcrum is also so positioned to effectively allow the users foot to pivot between contact with the heel-contacting portion and the forefoot contacting portion. In a preferred embodiment, the dimension of the offset so defined is preferably at least 5 mm, more preferably at least 10 mm, preferably in the range from 5 to 25 mm, more preferably in the range 10 to 20 mm and still more preferably in the range 14 to 18 mm, e.g. about 15 mm. Such dimensions may alternatively or additionally be applied in all embodiments to a space available perpendicularly downwards from a virtual plane (the fulcrum plane) in which the pivot point of the fulcrum falls which fulcrum plane is parallel with the fore plane, such dimensions applying at any perpendicular within the boundary of the aft portion of the footplate but preferably within a heel's length of the fulcrum, e.g. from 5 mm to 40 mm aft of the fulcrum and may be referred to as the void depth.

Typically, the footplate is of overall dimensions typical of a conventional footplate and may usually be of length 20-45 cm, preferably 25-40 cm. Typically a footplate is longer in the longitudinal direction from aft to fore than in the lateral direction, e.g. 2-5× longer.

Preferably the fulcrum extends laterally across the footplate and may preferably extend entirely across the footplate in a lateral direction. Ideally, the fulcrum should be positioned so that the fore portion is the larger of the fore and aft portions.

The fulcrum may be provided as a fixed and pre-formed or adjustable and optionally removable (or neutralisable) feature in the footplate.

In one preferred embodiment, the footplate comprises a preformed fixed or adjustable joggle or step formed in the footplate. The joggle or step is formed such that the surface of the footplate joggles or steps down from a relatively elevated fore portion to an aft portion. Preferably the joggle or step extends laterally across the footplate.

In one embodiment, the fixed and preformed or adjustable joggle or step provided in the footplate is the fulcrum.

According to a preferred embodiment referred to above, the lower or aft portion of the footplate is effectively stepped down or "joggled" down to provide a void in which the drummer's heel can drop into with the step or joggle providing a defined area for the front portion of the drummer's heel to initially strike the footplate. Using the "heel-toe" technique the drummer's foot can then be rocked forward to make contact with the upper portion of the returning joggled footplate, in turn propelling the beater to strike the drum for a second time.

The relative position of the fulcrum along the length of the footplate may be fixed or variable. A fixed relative position may arise by providing the fulcrum as a pre-formed and permanent joggle or step formed in the footplate which may define the fore and all portions of the footplate. Thereby the only adjustment that may optionally be achievable may be the position of the pivot mount to the base plate (at the aft of the footplate) and for the position of the mounting to the drive mechanism at the for e portion (distal to the pivot mount to the base plate). It is therefore envisaged a further embodiment whereby the effective distance of the fulcrum (e.g. joggle or step) from the baseplate pivot (i.e. the pivot mount about which the footplate may pivot in relation to the baseplate) may be adjusted, whether or not the position or configuration of the fulcrum (e.g. joggle or step) on the footplate is adjustable, and this adjustment may be by adjusting the relative position of the baseplate pivot on the footplate. Such adjustment may be effected by any suitable mechanism, such as a baseplate pivot that is mounted to a telescopic (preferably securable telescopic) extension or section of the footplate or a baseplate pivot that is moveable relative the base plate, e.g. along a track or slot thereon, and mounted on a telescopic extension of the footplate. In one embodiment, the relative position of the baseplate pivot is adjustable by providing the footplate connection to the baseplate by way of a hinge fixable to the footplate, which hinge may (when disconnected from the footplate) rotate between a forward direction (providing an extended distance between baseplate pivot and fulcrum) and a rearward direction (providing a shortened distance between baseplate pivot and fulcrum).

Optionally, the joggle or step formed in the footplate, whether or not it provides the fulcrum, may be adjustable. Accordingly, for example, the step may be formed by the adjoining of a first fore element forming the fore portion and a second aft element forming the aft portion in such a configuration that a step is formed between them (by the fore and aft elements being perpendicularly offset relative to one another and overlapping slightly and in particular the fore element being adjoined to the top of the aft element). The degree of overlap may be adjustable such that the step, which may provide the fulcrum, is adjustable closer or further from the aft of the footplate. Alternatively, the adjustability may be provided by a portion of an otherwise fixed and pre-formed joggle or step, which is capable of acting as a fulcrum, e.g. an interior laterally extending portion of the joggle or step, may be moveable longitudinally (e.g. along a track or shaft) along the footplate, extending from an aft surface of the joggle or step toward the aft of the footplate.

In another embodiment a fixed, but preferably an adjustable and optionally removable block element or striking block positioned or positionable on the footplate may provide the fulcrum. Preferably, such block element or striking block is provided in addition to the joggle or step (which is preferably pre-formed) and is positioned aft of the joggle or step providing the fulcrum, whilst the 'joggled-up' fore portion comprises the forefoot contact-receiving portion.

A footplate according to this embodiment may comprise a fulcrum provided by an adjustable block attached to a surface of the footplate, which adjustable block provides an elevated heel contact-receiving portion relative an aftmore portion of the footplate.

Preferably, the adjustable block is adjustable along a length of the surface of the footplate whereby the relative mechanical advantage achievable via the forefoot- and heel-contacting portions may be varied. For example, it may be adjustable over a length of up to 10 cm, or up to 5 cm.

According to the embodiment in which a joggle or step is provide and a separate block element or striking block is provided as the fulcrum, the step or joggle may be provided in the footplate in association with or to the fore of the adjustable block whereby the fore portion of the footplate comprising the forefoot contact-receiving surface defines a plane elevated relative the aft portion of the footplate.

Sometimes a drummer prefers to play with their heel permanently resting on the heel rest of a pedal, operating the pedal by pivoting their foot about their heel in a technique described as playing "heel-down". For comfort and control sometimes a drummer will swap between "heel-up", "heel-down" and "heel-toe" playing styles during a single performance, the last of which the present invention is designed to facilitate in particular. To facilitate this alternative "heel-down" technique the present invention provides an additional moveable heel support block that when engaged provides an elevated platform on which the drummer can rest their heel, the height of which enables the drummer, when pivoting their foot about their heel, to contact the upper or fore portion (comprising the forefoot contact-receiving portion) of the footplate with the upper portion of their foot. With the heel support block moved out of the way (or disengaged) the drummer's heel is free to drop into the void enabling the front portion of the drummer's heel to contact the heel contact-receiving portion, which is preferably the aft surface of the fulcrum which may be provided by a dedicated striking bock or the stepped or joggled striking area.

Thus, according to this embodiment, a footplate comprises a fore portion which defines a plane perpendicularly offset from a plane defined by an aft portion, wherein a moveable platform is provided for moving between an engaged position in which it is positioned on or above the aft portion of the footplate and upon which a users heel may rest and thereby reducing or neutralising the offset in elevation between the fore and aft portions and a disengaged position in which the platform is not positioned on or above the aft portion.

The moveable heel support or moveable platform may have the effect of (partially) filling the void as defined above or neutralising the fulcrum (so that it may not be possible, temporarily, for the user's foot to pivot about the fulcrum).

In a particularly preferred embodiment, the footplate comprises a rigid pre-formed longitudinal element having a substantially fore portion defining a fore plane and comprising a forefoot contact-receiving portion and a substantially planar aft portion defining and aft plane, which fore and aft planes are substantially parallel but offset perpendicularly so that the fore plane is elevated relative to the aft plane and the fore and aft portions are separated by a step or joggle. The step or joggle or alternatively a further block element or striking block, which is preferably adjustable and provided aft of the step or joggle, may provide a fulcrum extending laterally across the footplate about which the user's foot may pivot to facilitate the heel-toe technique described above. The extent of offset should be such as to facilitate effective pivoting by a user's foot. The step or joggle should be relatively sharp, e.g. extending longitudinally no more than about 3 cm preferably no more than about 2 cm. The footplate should preferably be configured for pivotal mounting in the aft portion preferably the aft end to a base plate and the footplate should preferably be configured for attachment at the fore portion thereof, preferably distal to the aft end to a drive mechanism for a drum beater.

A drum pedal assembly according to another aspect of the invention comprises, as mentioned above a base plate having mounted thereon a front frame for supporting a drum beater and drive axel and a drum beater supported by the front frame; a footplate pivotally mounted to the base plate at an aft portion of the footplate; and a drive mechanism configured with a fore portion of the footplate and the drum beater so that application of a force against footplate causes pivotal movement of the footplate about the pivotal mounting and causes the drive mechanism to effect propulsion of the drum beater, characterised in that the footplate is as defined above.

In a further aspect of the invention mentioned above, there is provided a footplate attachment for a footplate for a drum pedal, the footplate attachment comprising a platform bound by at least one edge and a means of permanently or releasably affixing the attachment to a substantially planar footplate for a drum pedal, wherein in use attached to a footplate the platform provides a forefoot contact-receiving surface and the at least one edge, or a striking block provided on the platform, provides a fulcrum about which a user's foot may pivot.

The footplate attachment has the effect of converting a conventional, flat planar footplate for a drum pedal into a footplate according to the first aspect of the present invention and optionally embodiments thereof as described herein. Thus the resulting adapted footplate assembly may comprise an elevated fore portion relative to an aft portion and a fulcrum, typically formed by an edge of the platform (positioned aftmost in situ).

Preferably, a footplate attachment in use attached to a fore portion of a footplate has at least one edge, or striking block, configured at the aftmost part of the platform which serves as the fulcrum whereby a user's foot may pivot between contacting respectively a heel contact-receiving portion and the forefoot contact-receiving portion. Thus, in use successive applications of force on the heel contact-receiving portion and forefoot contact-receiving portions are capable of causing successive propulsions of a drum beater configured therewith.

The platform may be of any suitable shape, e.g. circular, oval or preferably oblong. In the preferred embodiment wherein the platform is of oblong shape in its planar dimension, the platform has four edges, one of which at any one time may be configured to act as the fulcrum. The height of the platform should be such as to enable the user to enhance the heel-toe technique and so the dimensions as indicated above are preferably applicable.

The platform may be configured to be attached to a footplate in one or more configurations so that the user may utilise various form factors provided by approaching the platform from different directions.

The means for affixing the attachment to a footplate may be any suitable means and optionally comprises a clamp arrangement for clamping the attachment to the footplate of a drum pedal or an adhering surface for adhering to the striking surface of a footplate.

According to a further embodiment, there is provided a method of manufacturing a footplate or footplate attachment according to aspect of the present invention. In one aspect, the method of manufacturing a footplate may comprise producing a rigid single element having a pre-formed and permanent joggle or step or may comprise producing two planar elements and adjoining them to form the footplate. Any suitable methods of manufacture known to the skilled person may be used, e.g. injection moulding, carving or cutting the footplate from a block or any other suitable method.

According to a further embodiment, there is provided a method of drumming which comprises the use of the heel-toe technique, said method comprises providing a drum pedal or drum pedal assembly as defined herein having a footplate, striking a heel contact-receiving portion of the footplate to effect a drum beat and pivoting the sole of the foot about the fulcrum thereon to then strike the forefoot contact receiving portion of the footplate to effect a second drum beat. There is thus further provided according to a related aspect a musical performance comprising the method of drumming.

According to a still further embodiment, there is provided a method of producing distributable or mass distributable musical recordings, which comprises configuring at least one and preferably a plurality of musical performances to be recorded including a drumming performance which comprises the use of the heel-toe technique, by providing a drum pedal or drum pedal assembly as defined herein having a footplate, striking a heel contact-receiving portion of the footplate to effect a drum beat and pivoting the sole of the foot about the fulcrum thereon to then strike the forefoot contact receiving portion of the footplate to effect a second drum beat, producing from a recording thereof after any mixing or post production steps a master and using said master to generate a plurality of distributable recordings. In a related aspect there is provided a master recording and/or a plurality of reproducible distributable recordings obtained or obtainable by said method.

A drum pedal may comprise numerous other components. Two other components are defined by separate inventive aspects described hereunder.

In one invention, there is provided an adjustable base drum clamping arrangement for a drum pedal assembly, the arrangement having a clamped configurations in which the base drum clamping arrangement is clamped to a base drum and an unclamped configuration in which the base drum clamping arrangement is not clamped to a base drum, the arrangement comprising a clamp comprising a lip and opposing clamping jaw for engaging the rim of a base drum, a base element comprising the lip and being moveably engaged with a baseplate of the drum pedal and movable, when disengaged, longitudinally back and forth along a length of the baseplate according to a guide element or guide slot, an upper element comprising the clamping jaw for cooperative engagement with the base element and movable with the base element longitudinally back and forth along a length of the baseplate, the base and upper elements preferably being of substantial planar body and, in use substantially parallel to one another, wherein the clamping arrangement when in clamped configuration is such that the base element and upper element are biased away from one another but the upper element is held in clamped configuration relative the baseplate by a compression element and wherein the base element or upper element is provided with a downward projecting protrusion configured for engagement with any one of a plurality of cooperating receiving apertures or slots provided distributed longitudinally along the base plate, whereby the clamping arrangement may be moved, without disengaging the clamp from the base drum, along a length of the baseplate by disengaging the protrusion from one cooperating aperture by manually lifting the base element against the biasing means, moving the arrangement longitudinally along the base plate and re-engaging the protrusion with another cooperating aperture. Thus, a very simple adjustment may be made to the clamping element to change the distance of the drum pedal from the base drum without unclamping the base drum. Preferably the compression element for clamping the upper element to the baseplate comprises a threaded rod protruding upward from the baseplate through longitudinally guide slots formed in the base element and upper elements and a corresponding nut (e.g. wing nut) to compress the upper element in position against a biasing means which provides the bias. The biasing means is preferably a spring co-located with the threaded rod. The upper element is preferably configured for cooperative engagement with the base element by way of an aperture in the upper element for receiving a backward and upward projection from the base element to provide a pivot about which the elements may pivot during clamping and unclamping from a base drum and to retain the upper and base elements in corresponding arrangement.

In one aspect, a drum pedal comprises a means of clamping the pedal to a rim of a drum comprises a clamp located into one or more of a plurality of slot features in a base plate of the drum pedal held releasably in a laterally secure position by a spring, whereby without the use of tools, the clamp can be manually lifted, repositioned and relocated into adjacent said slot features, thus providing a plurality of laterally secure clamping positions In another invention, there is provided a tension mechanism for a drum beater arrangement, the tension mechanism comprising a tension spring attached or attachable at one end to a tension cam associated with a drum beater axel and the other end is configured to engage with a tension variable element in the form of a cam plate pivotally mounted to a frame of the drum pedal, the cam plate comprising a profiled slot for receiving the tension spring or hook or clasp associated therewith, the profiled slot comprising a series of notches in an upper edge thereof for receiving said tension spring or hook or clasp associated therewith, each notch representing a different tension applied to the tension spring, whereby the tension on the spring may be adjusted by moving the cam plate about its pivot to cause the spring or hook or clasp associated therewith to engage with a different notch.

In one aspect, a drum pedal comprises a means of providing adjustable tension to a drive axel on which a beater is mounted is achieved through a pivoting cam plate, whereby said cam plate incorporates a profiled slot featuring a plurality of indexing notches into which an extension spring can hook onto, whereby the distance between each said indexing notch and said cam plate pivot differ so that when said cam plate is rotated about said pivot different indexing notches are selected producing different tensions on the extension spring.

In a further aspect of the invention, there is provided a drum pedal having a plurality of adjustable elements comprising any combination of two or more independent or inter-dependent adjustable elements described herein.

In further aspects of the invention, there is provided a drum pedal and a drum pedal attachment as described below:

In one further aspect, there is provided a drum pedal including a footplate comprising of one or more parts whereby the lower end of said footplate pivots about an axis and the opposite end of said footplate is elevated higher than the lower end of said footplate forming a step in said footplate whereby the step in said footplate forms a dedicated area for the drummer's foot to strike.

Further and preferred features of a drum pedal according to this aspect are defined below:

A drum pedal according to this aspect, in which a striking block is releasably attached in front of the step in said footplate in an arrangement such that adjustment in the striking block position is possible enabling said striking block to become a dedicated and adjustable area for the drummer's foot to strike, whereby positioning said striking block further away from said pivot increases mechanical advantage in propelling the beater forward to hit the drum and moving said striking block closer to said pivot produces a faster response since said striking block does not have to travel as far to propel the beater to hit the drum.

A drum pedal according to this aspect, whereby an elevated platform to raise and support the drummer's heel is provided in such an arrangement that said elevated platform can also be lowered to provide the drummer's foot with an unobstructed path to strike said step in said footplate. Such a drum pedal preferably comprises an elevated platform to raise and support the drummer's heel in such an arrangement that said elevated platform can also be lowered to provide the drummer's foot with an unobstructed path to strike said striking block.

A drum pedal according to this aspect, whereby the arrangement is such that the position of said footplate in relation to said pivot can be adjusted thus adjusting the distance between said pivot and said step in said footplate, whereby positioning said step further away from said pivot increases mechanical advantage in propelling the beater forward to hit the drum and moving said step closer to said pivot produces a faster response since said step block does not have to travel as far to propel the beater to hit the drum.

A drum pedal according to this aspect, whereby the footboard comprises an upper footplate, a lower footplate and a striking block, whereby the step is formed by clamping the striking block releasably and adjustably between said upper and lower footplates, whereby said lower footplate pivots about said axis and said upper foot board is elevated above said lower footplate, whereby clamping said striking block further away from said pivot increases mechanical advantage in propelling the beater forward to hit the drum and clamping said striking block closer to said pivot produces a faster response since said striking block does not have to travel as far to propel the beater to hit the drum. Preferably, in such a drum pedal the footplate assembly can be reconfigured by flipping the striking block longitudinally in the assembly between said upper and lower footplates, whereby each end and face of the striking block differ in form factor to provide the drummer with a choice of playing surfaces and size of striking area.

In a second further aspect, there is provided a drum pedal attachment comprising a raised platform, a clamping bar, and fixings, whereby said clamping bar and fixings are used to clamp said raised platform releasably to the flat footboard of a standard drum pedal, in such an arrangement that the lower edge of said platform creates a step in the combined footboard assembly whereby the step forms a dedicated area for the drummer's foot to strike, whereby positioning and clamping said raised platform further away from the drum pedal's footboard pivot increases mechanical advantage in propelling the beater forward to hit the drum and positioning and clamping said raised platform closer to said pivot produces a faster response since said striking area does not have to travel as far to propel the beater to hit the drum.

Further and preferred features of a drum pedal attachment according to this aspect are defined below:

A drum pedal attachment according to this aspect, whereby each end and face of the raised platform differ in form factor to provide the drummer with a choice of playing surfaces and shape of striking area depending on the orientation of said raised platform when clamped to the drum pedal's footboard.

A drum pedal attachment according to this aspect whereby instead of using the formed edge of said raised platform as the striking point, said raised platform is fitted with a striking block whereby said striking block provides an area for the drummer's foot to strike, whereby said striking block is reversible, removable and replaceable to offer the drummer a choice of playing surfaces and form factors.

In a third further aspect, there is provided a drum pedal attachment comprising a raised platform that can be adhered to the flat footboard of a standard drum pedal, in such an arrangement that the lower edge of said platform creates a step in the combined footboard assembly whereby the step forms a dedicated area for the drummer's foot to strike.

The invention will now be described solely by way of example and with reference to the accompanying drawings.

In FIG. AA an example of an existing drum pedal 52 is shown whereby a typically flat footplate 44 is fixed to a base plate 43 via a hinge block 41 and a pivot pin 42. The pivot pin enables the footplate to rotate about the axis of the pivot pin. Also attached to the base plate is a front frame 50 which provides support to a drive axel 48, the drive axel being allowed to rotate about its axis. A drive cam 47 is fixed to the drive axel. The drive axel is also fixed to a tension cam 46 which is held in a pre-determined and usually adjustable position about the drive axel's axis by an extension spring 45 that links the tension cam to the front frame. The extension spring provides means of adjustable tension between the tension cam and front frame in such an arrangement as to allow the drive axel to rotate about the drive axel's axis if manually forced to do so, yet produces enough tension to force the drive axel to return to the pre-determined position about its axis when the manual force is released. The drive cam is attached to footplate by means of a link strap 49 in such an arrangement that when the footplate is depressed by the drummer's foot the footplate rotates about its pivot pin pulling down on the link strap in turn pulling on the drive cam and rotating the drive cam about the drive axel. A clamp 51 is used to secure the pedal to the rim of a drum and a beater 40 is attached to the drive cam so that when the footplate is depressed by the drummer's foot the beater is rotated and propelled forward to strike the drum. Removing the downwards force on the footboard allows the beater to rotate back to the pre-defined position ready for the next operation.

FIG. 1 shows a drum pedal with an assembly 53 comprising a front frame 3, a drive axel 11, a drive cam 4, a tension cam 5, an extension spring 6, a cam plate for adjusting the tension 7, a base plate 2, a clamp 13, a link strap 10, a beater 12, and a hinge block 16 to provide means to pivot the footplate assembly 54. The operation of the assembly 53 follows that of the example drum pedal 52 shown in FIG. AA with the exception of the footplate assembly 54. In FIG. 1 the footplate assembly 54 comprises a stepped or joggled footplate 1. Attached releasably to the joggled footplate is a heel striking block 8 that creates a defined point for the front portion of the drummer's heel to strike (and preferably to pivot about and therefore provides a fulcrum). The striking block can be adjusted in position along the footboard to compliment the drummer's foot size, playing technique and comfort. The footboard assembly is fixed to the base plate via the hinge block and a pivot pin 14 (providing a baseplate pivot). The pivot pin enables the footplate to rotate about the axis of the pivot pin. Also provided is a heel support block 9 which can be attached to the hinge block 16 and pivot either by using the same pivot pin as the footplate or as shown using its own pivot pin 15 whereby the heel support block is free to pivot about its pivot pin independently of the pivoting action of the footplate assembly.

Figure 2A:
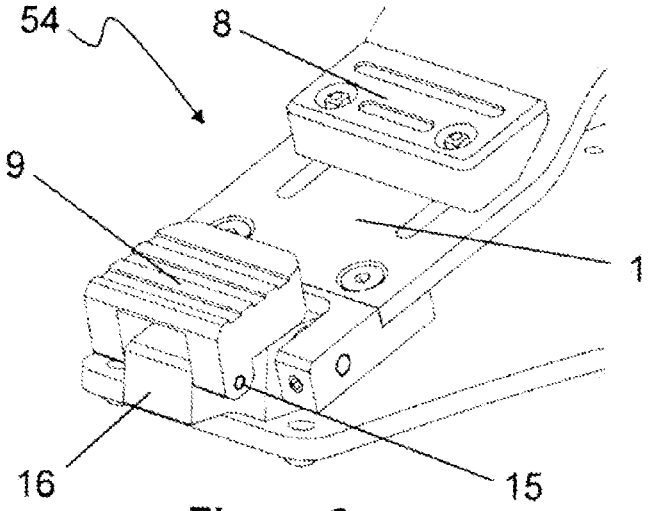
FIGS. 2*a*, 2*b* and 2*c* show how the heel support block can move out of the way to provide the front portion of the drummer's heel a clear path to contact the striking block.

FIG. 2*a* shows the lower portion of the footboard assembly 54 with the heel support block 9 pivoted forward fully and providing a support platform on which the drummer may rest their heel in order to facilitate the "heel-down" playing technique whereby the drummer pivots the front of their foot about their heel. The heel support block can be pivoted into this forward position by hand, drum stick, or with a flick of the drummer's toes.

Figure 2B:
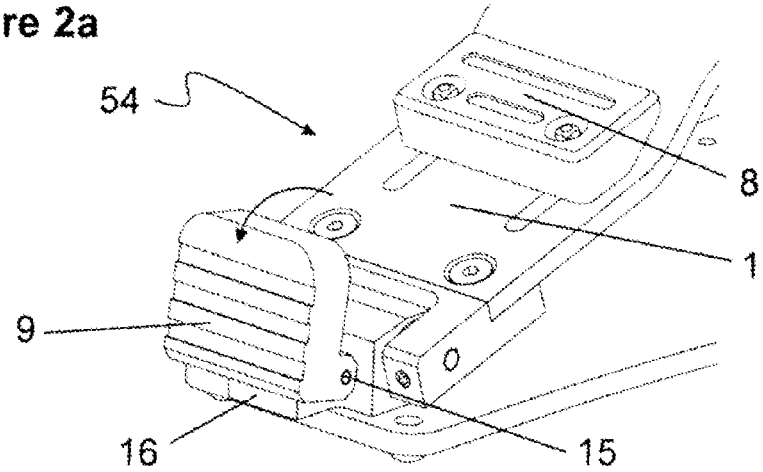

FIG. 2*b* shows the lower portion of the footboard assembly 54 with the heel support block 9 in the process of being pivoted backwards into a stowed position. The heel support block can be pivoted backwards by hand, drum stick, or with a flick of the drummer's heel.

Figure 2C:
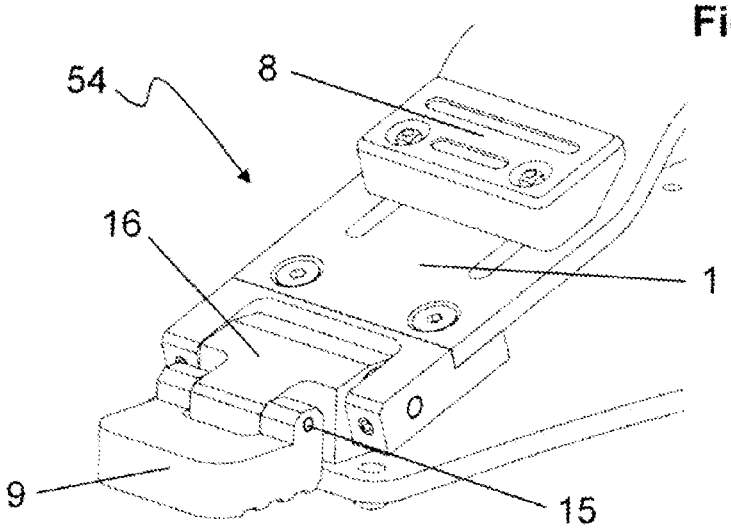

FIG. 2*c* shows the lower portion of the footboard assembly 54 with the heel support block 9 in the fully stowed position creating unrestricted access for the front portion of the drummer's heel to contact the striking block 8. The heel support block can be pivoted backwards by hand, drum stick, or with a flick of the drummer's heel.

Figure 3:
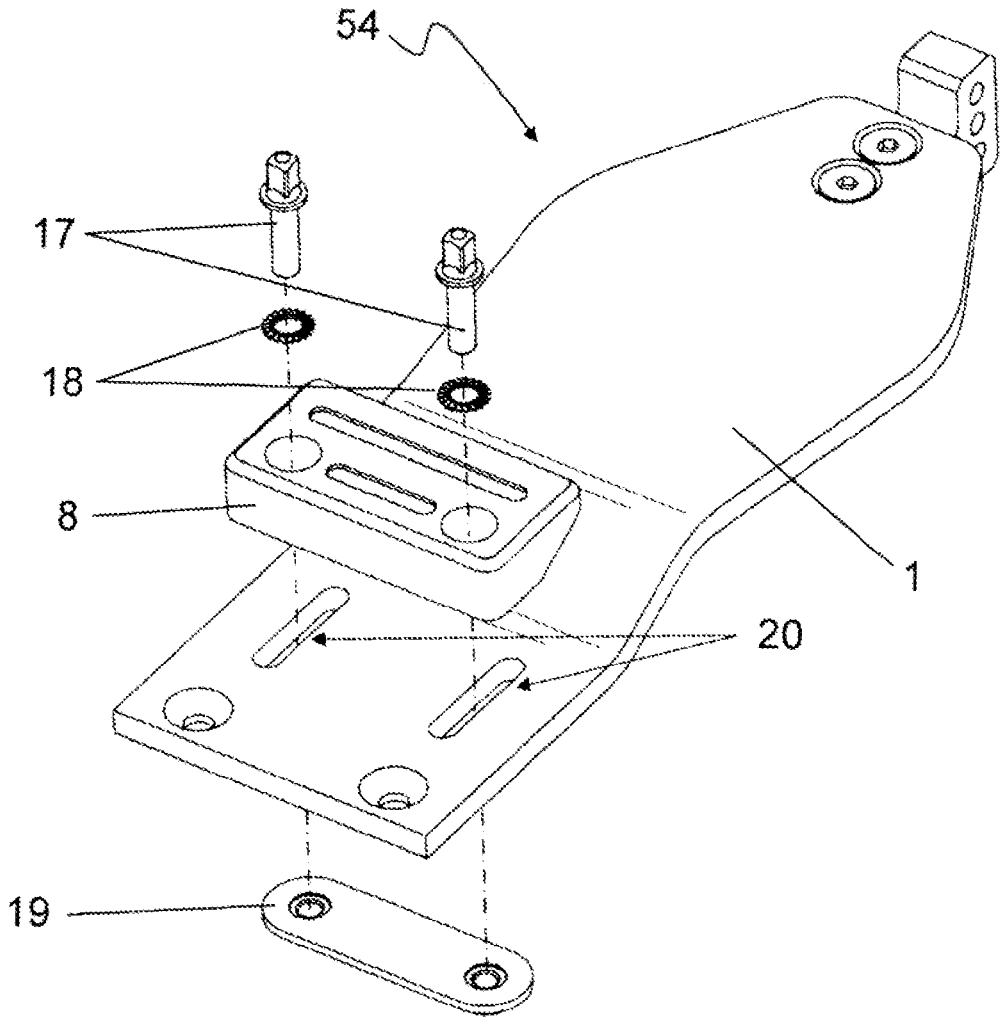
FIG. 3 shows details of the striking block.

FIG. 3 shows the footboard assembly 54 with further detail of the striking block attachment whereby screws 17 either with or without washers 18 pass through the striking block 8 and through slots 20 or holes in the joggled footplate 1 into a threaded bar nut 19, whereby once the screws are tightened the striking bock is fixed releasably to the footboard in the drummer's chosen position.

Figure 4A:
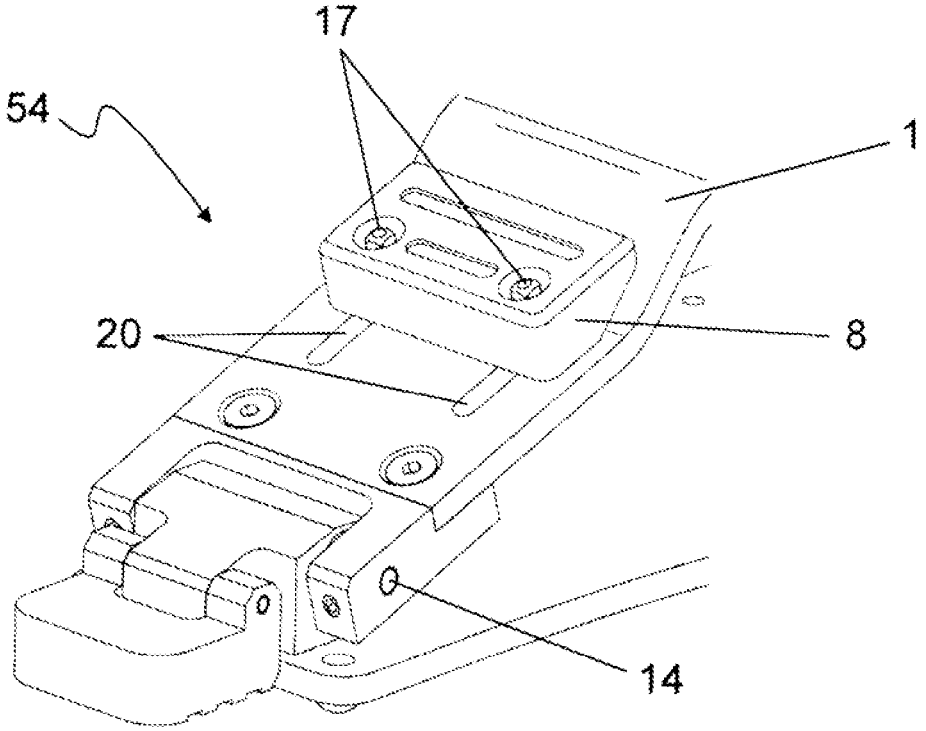
FIGS. 4*a* and 4*b* show adjustability of the striking block.

FIG. 4*a* shows the striking block 8 in the uppermost position whereby the striking position is further away from the footboard pivot pin 14 offering increased mechanical advantage in propelling the beater forward when the drummer strikes the striking block which may be preferred by some drummers. This uppermost position may also be preferred by drummers with small feet enabling them to reach both the striking block with their heel and upper portion of the footboard with their toes with a simple "heel-toe" rocking motion without having to reposition their foot up and down the footboard.

Figure 4B:
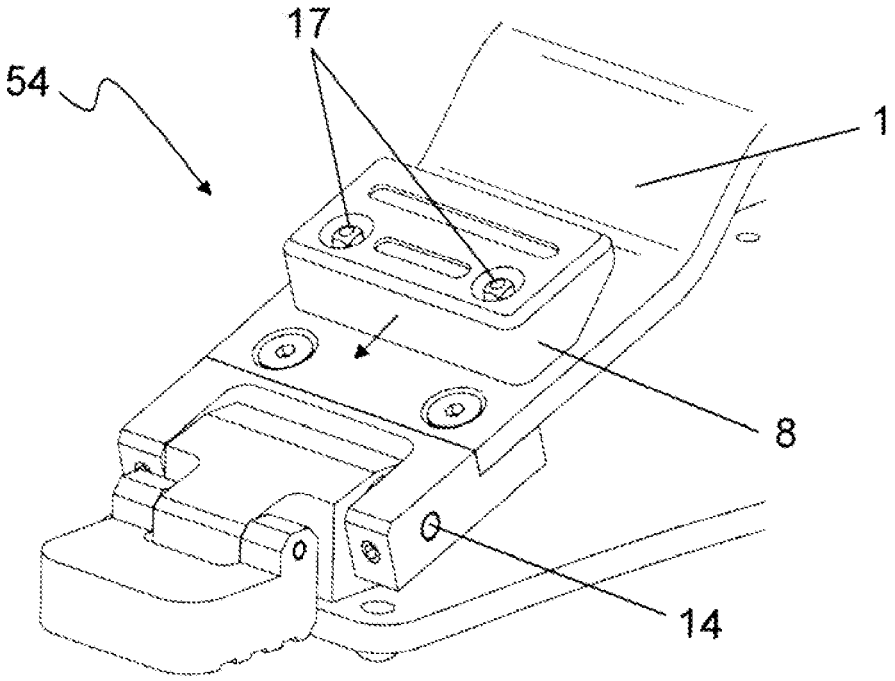

FIG. 4*b* shows the striking block 8 in the lowermost position whereby the striking position is closer to the footboard pivot pin 14 offering less of a mechanical advantage compared to the arrangement in FIG. 4*a* but offering the drummer a faster response since the striking block does not have to travel as far to propel the beater to hit the drum. This lowermost position may also be preferred by drummers with larger feet enabling them to contact the striking block with the front portion of their heel rather than with the arch of their foot.

Figure 5:
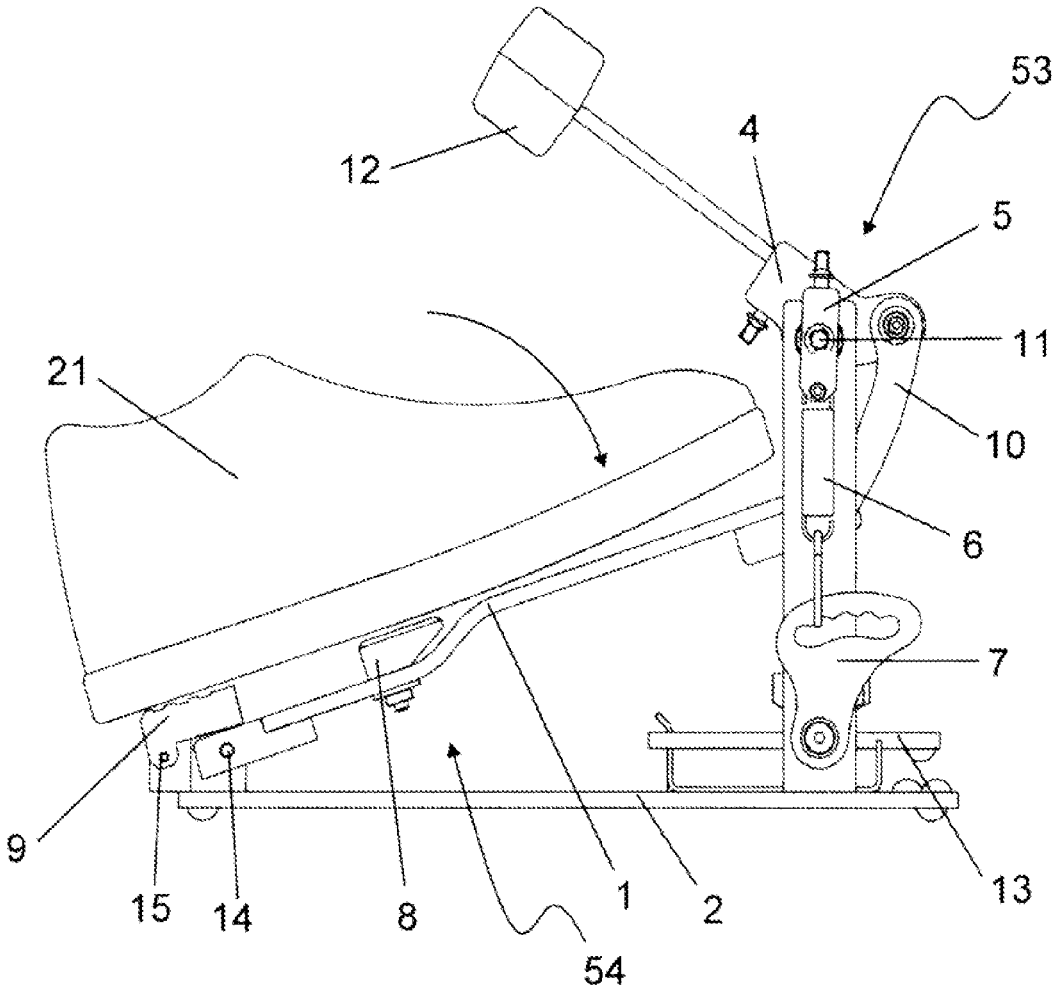
FIG. 5 shows how the heel support block provides a means of supporting the drummer's heel when playing the "heel-down" technique.

FIG. 5 shows how the drummer's foot interacts with the heel support block in the fully forward position (as described previously in FIG. 2*a*) in order to play the "heel-down" technique, whereby the heel of the drummer's foot 21 rests on the heel support block 9 which keeps the drummers heel above or level with the striking block 8 preventing the heel from applying concentrated force to the striking block but enabling the toes of the foot to contact and provide a downward force on the front portion of the footboard 1 when the drummer pivots their foot about their heel. Applying such a downwards force on the front portion of the footboard as shown by the direction of the unlabeled arrow rotates the footboard assembly 54 about its pivot pin 14 and through linkages in the front frame assembly 53 propels the beater 12 forward to strike the drum.

Figure 6A:
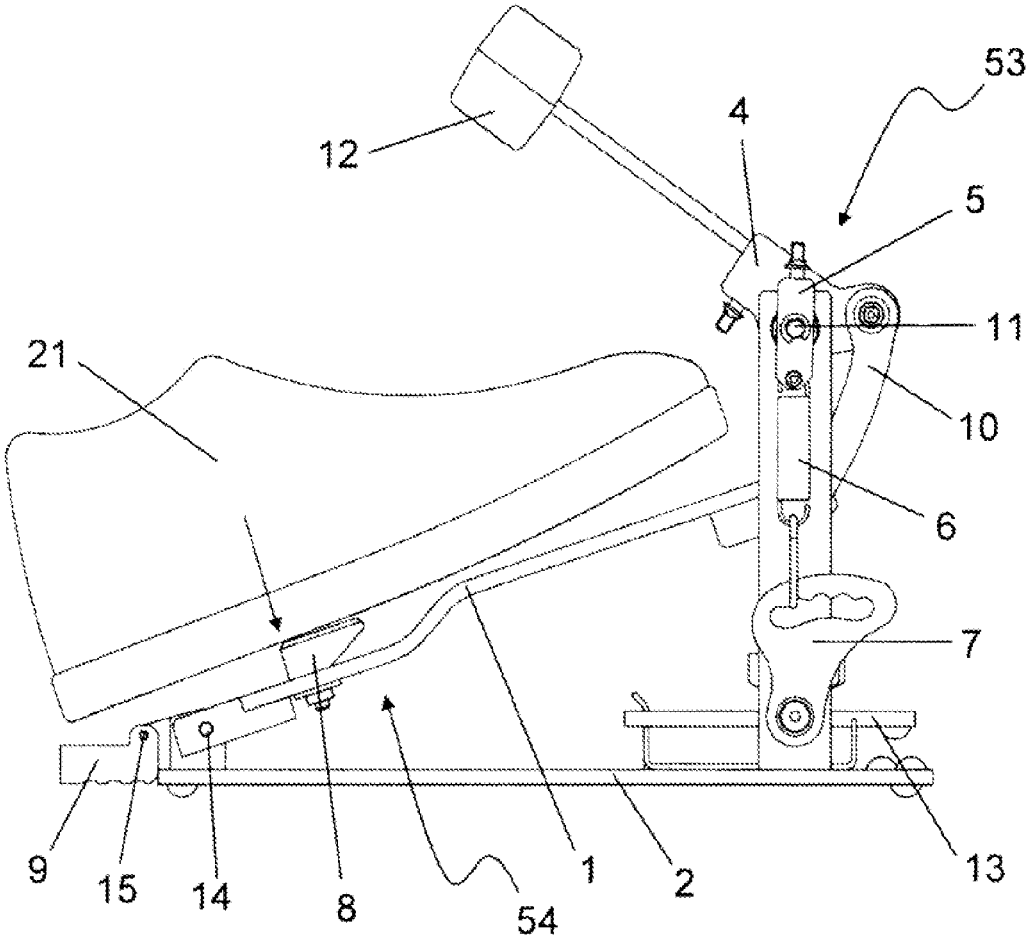
FIG. 6*a* shows how with the heel support block moved out of the way the drummer's heel has clear access to strike the striking block, in turn propelling the beater to strike the drum.

FIG. 6*a* shows how the drummer's foot 21 interacts with the striking block 8 when the heel support block 9 is pivoted backwards in the stowed position (as described previously in FIG. 2*c*) whereby the front of the drummer's heel can strike and provide a downward force on the striking block. Applying such a downwards force on the striking block as shown by the direction of the unlabeled arrow rotates the footboard assembly 54 about its axis 14 and through linkages in the front frame assembly 53 propels the beater 12 forward to strike the drum. During operation the striking block's 8 relative close proximity to the footboard pivot pin 14 offers little mechanical advantages to keep the beater against the drum head and with the drummer's toes raised slightly above the footboard 1 the beater 12 and footboard assembly 54 are allowed to return to their start position under the force of extension spring 6, enabling the drummer to perform the "heel-toe" technique as shown in FIG. 6*b*.

Figure 6B:
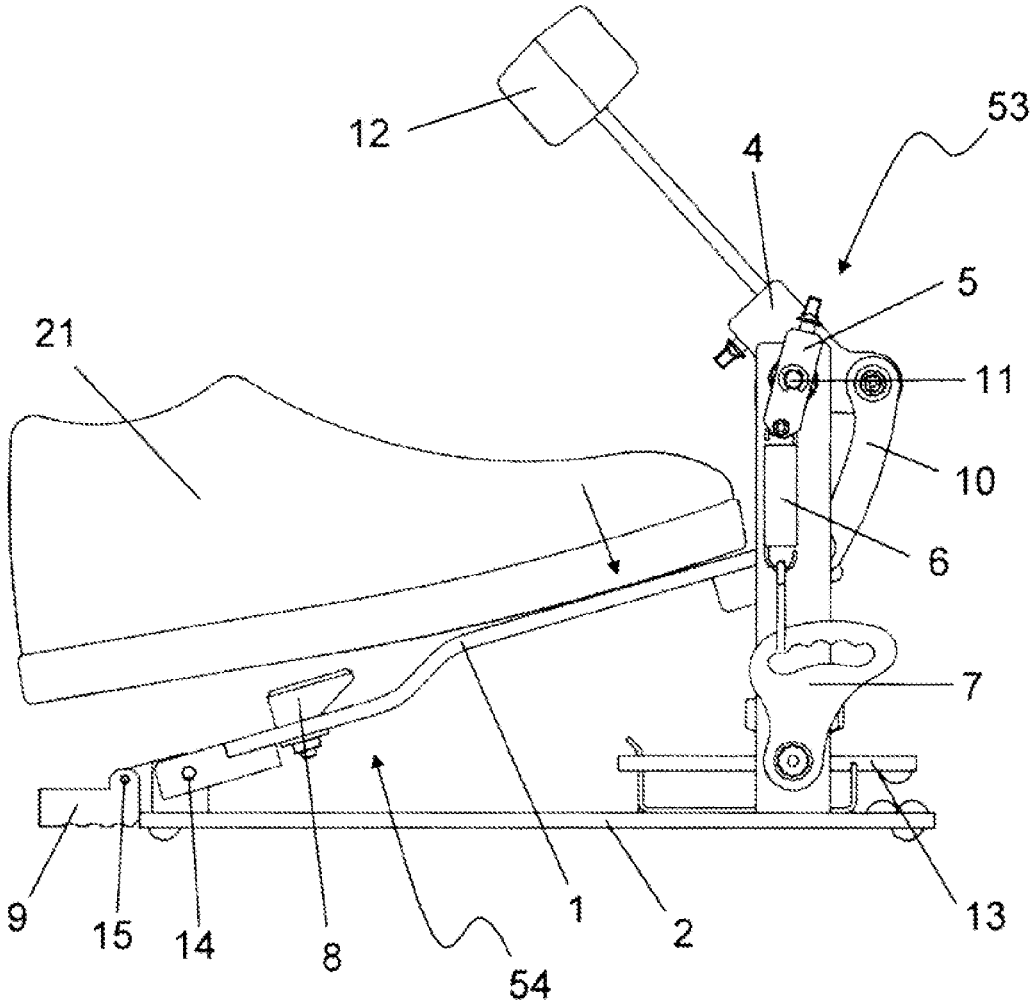
FIG. 6*b* shows after the drummer's heel strikes the striking block, the drummer's foot can be rocked forward to make contact with the upper portion of the returning joggled footplate, in turn propelling the beater to strike the drum for a second time.

FIG. 6*b* shows how the drummer quickly rocks their foot 21 forward using the "heel-toe" technique so that when the returning footplate 1 comes into contact with the toes or ball of the drummer's foot, the footplate is depressed again shown by the direction of the unlabeled arrow propelling the beater 12 forward to strike the drum for a second time.

Figure 7A:
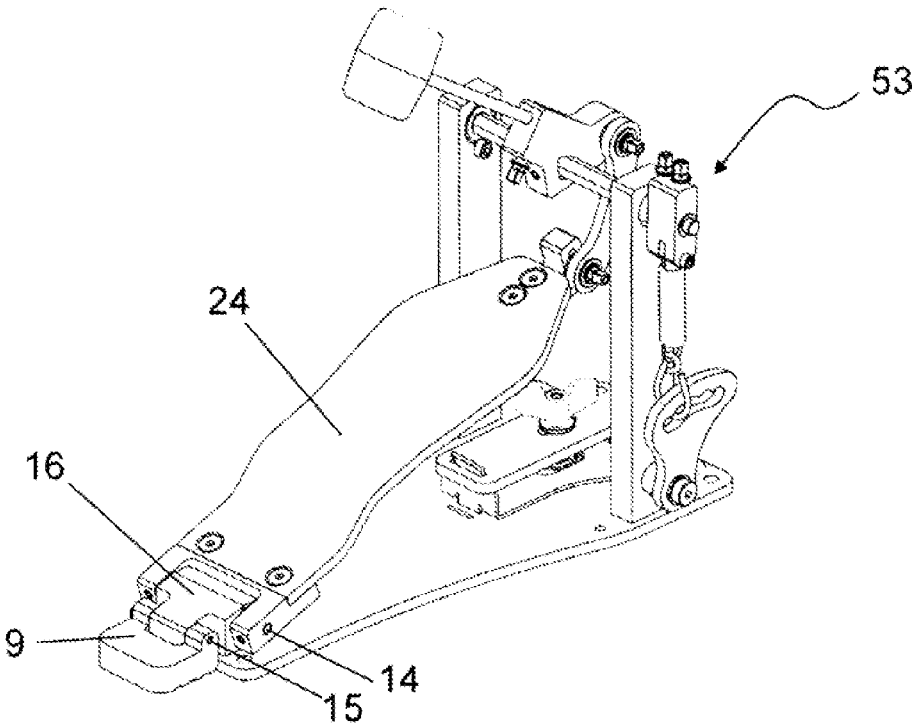
FIGS. 7*a* and 7*b* show alternative arrangements of the invention with no striking block whereby the joggled footplate itself provides the contact point for both heel and toe strikes.

FIG. 7*a* shows an alternative embodiment in which there is no striking block and whereby the joggle or stepped portion of the joggled footboard 22 provides the contact point at which the drummer strikes their heel, the footboard being attached to the front frame assembly 53 and hinge block 16 as described in FIG. 1.

Figure 7B:
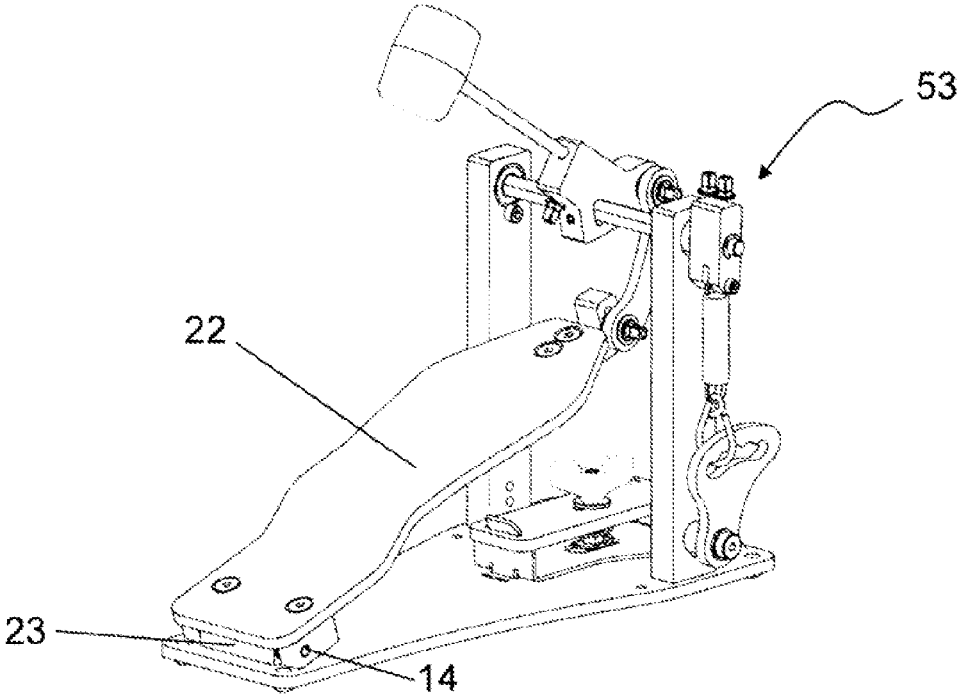

FIG. 7*b* shows an alternative embodiment in which there is no heel support block or striking block and whereby the joggle or stepped portion of the joggled footboard 22 provides the contact point at which the drummer strikes their heel, the footboard being attached to the front frame assembly 53 and hinge block 16 as described in FIG. 1.

Figure 7C:
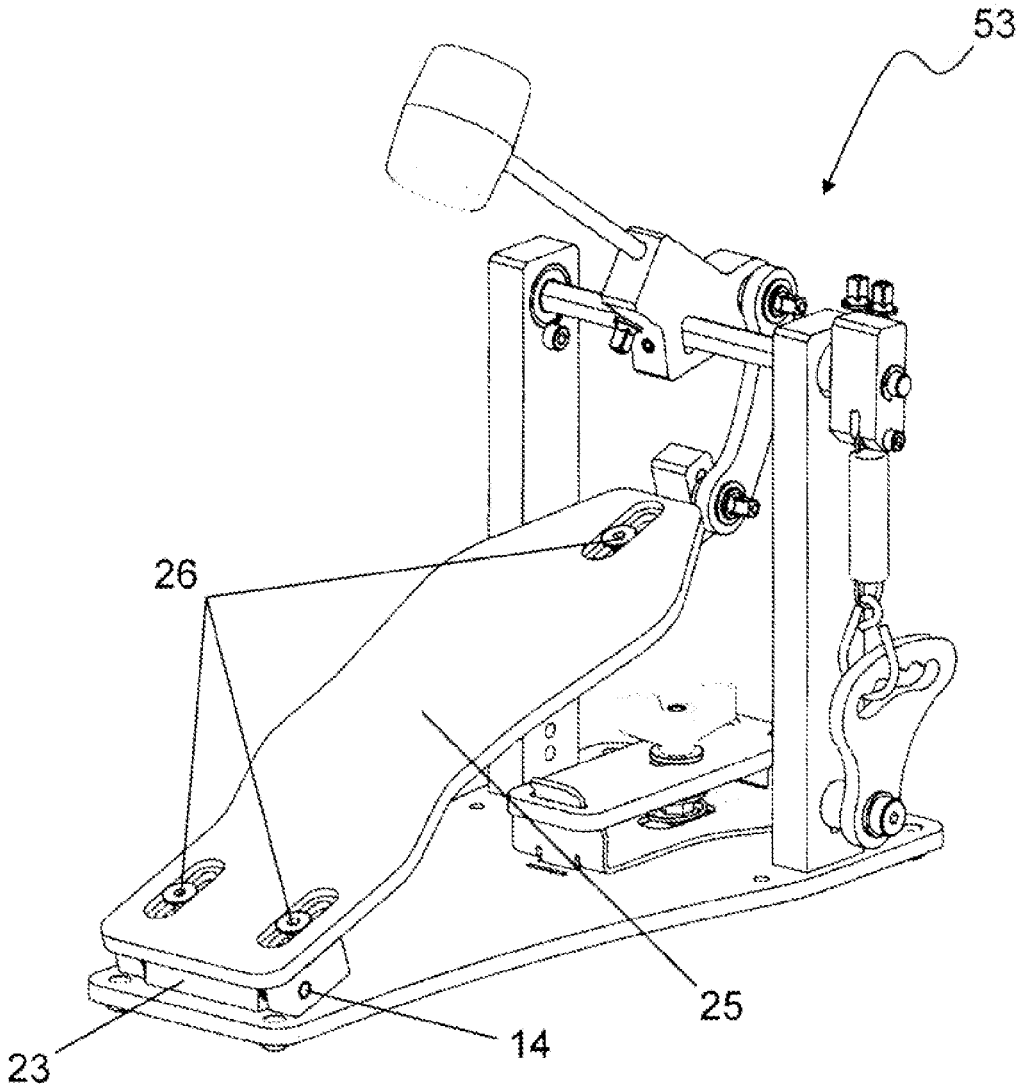
FIG. 7*c* shows an alternative arrangement of the invention with no striking block whereby the joggled footplate itself provides the contact point for both heel and toe strikes and whereby the joggled footplate's position in relation to the footplate's hinging axis can be adjusted.

FIG. 7*c* shows an alternative embodiment as described in FIG. 7*b* and whereby the position of the joggled footplate 25 in relation to the footplate's pivot pin 14 can be adjusted. Adjustment is achieved in this example by slackening the fixings 26 and, repositioning the footplate by allowing it to slide on the slots and then re-tightening the fixings. Repositioning the footplate in this way effectively moves the joggled or stepped contact point at which the drummer strikes their heel closer or further away from the pivot pin 14. In addition, and to provide further adjustment, the hinge block 23 can be repositioned on the base plate using a similar means of adjustment. As described in FIG. 4*a*; with the heel striking area positioned further away from the footboard pivot pin 14, there is an increased mechanical advantage in propelling the beater forward when the drummer strikes the striking area which may be preferred by some drummers. This uppermost position may also be preferred by drummers with small feet enabling them to reach both the striking area with their heel and upper portion of the footboard with their toes with a simple "heel-toe" rocking motion without having to reposition their foot up and down the footboard. As described in FIG. 4*b*; with the striking area closer to the pivot pin 14 there less of a mechanical advantage but offers the drummer a faster response since the striking area does not have to travel as far to propel the beater to hit the drum. This lowermost position may also be preferred by drummers with larger feet enabling them to contact the striking area with the front portion of their heel rather than with the arch of their foot.

Figure 8A:
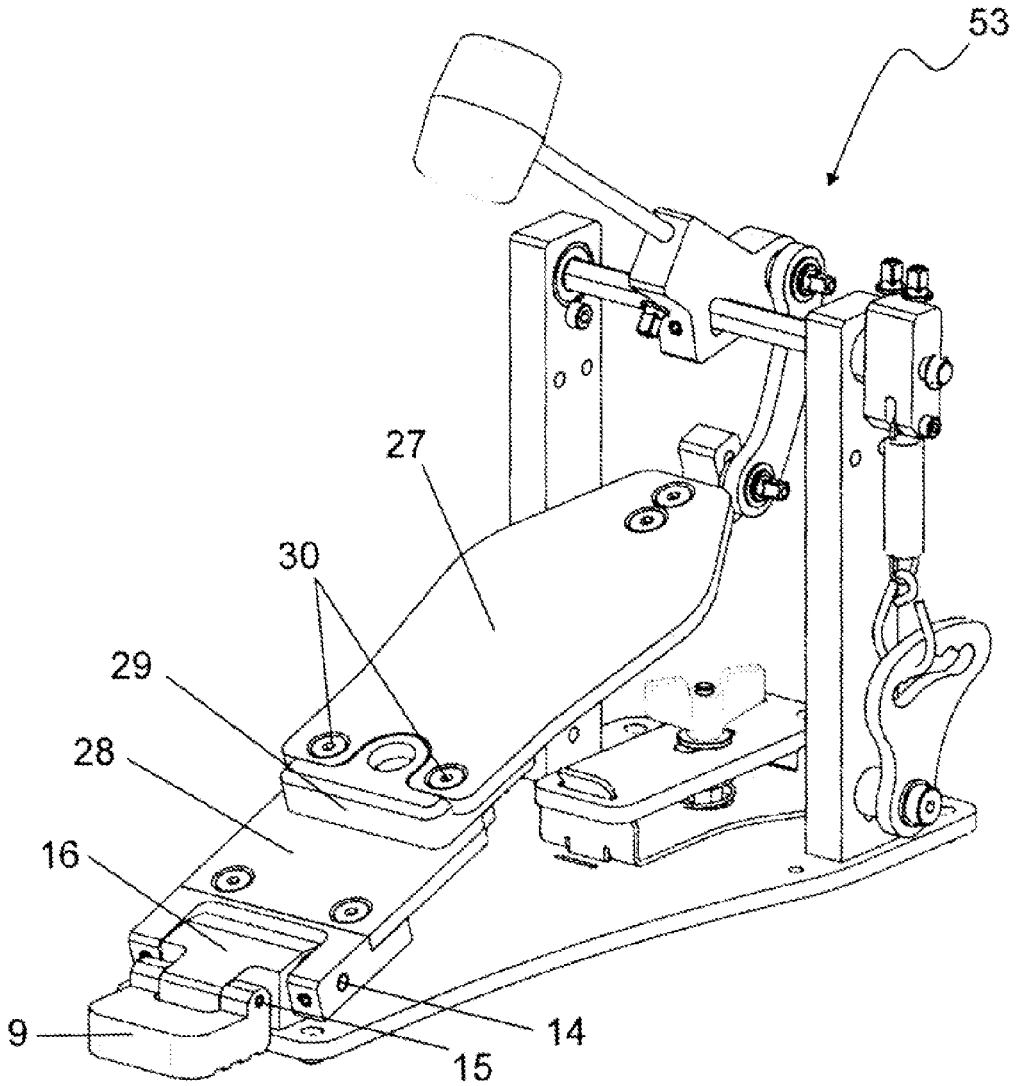
FIG. 8*a* shows an alternative arrangement of the invention whereby the step in the footplate is created using a number of components that are configurable to provide the drummer with options on heel striking position and striking block form factor.

FIG. 8*a* shows an alternative embodiment to FIG. 1 whereby the step in the footplate is created using a number of components that are configurable to provide the drummer with options on heel striking position and striking block form factor. The footboard is attached to the front frame assembly 53 and hinge block 16 as described in FIG. 1 with the footboard comprising of an upper footboard 27, a lower footboard 28, and a striking block 29 with fixings 30 providing a means of releasably securing the striking block in a chosen position between the upper and lower footboard components.

Figure 8B:
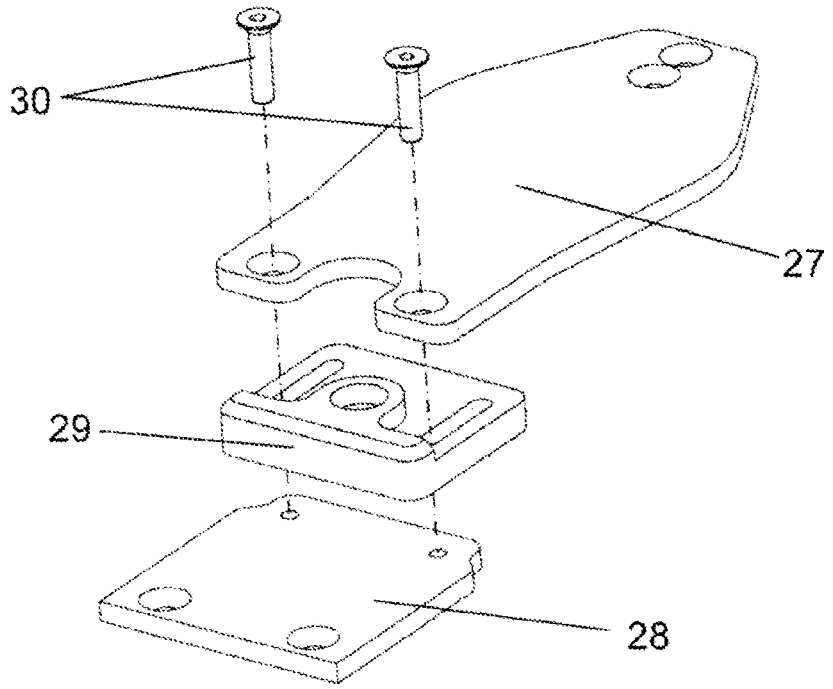
FIG. 8*b* shows an arrangement of FIG. 8*a* whereby the striking block position can be adjusted.

FIG. 8*b* shows the footboard components described in FIG. 8*a* in further detail whereby the fixings 30 can be slackened and the slots in the striking block 29 provide movement to enable the striking block to be positioned further up or down the footboard assembly before the fixings are re-tightened to lock the striking block in the chosen position between the upper footplate 27 and lower footplate 28. Positioning the striking block closer and further away from the footboard pivot pin have the effects as described in FIGS. 4*a* and 4*b*.

Figure 8C:
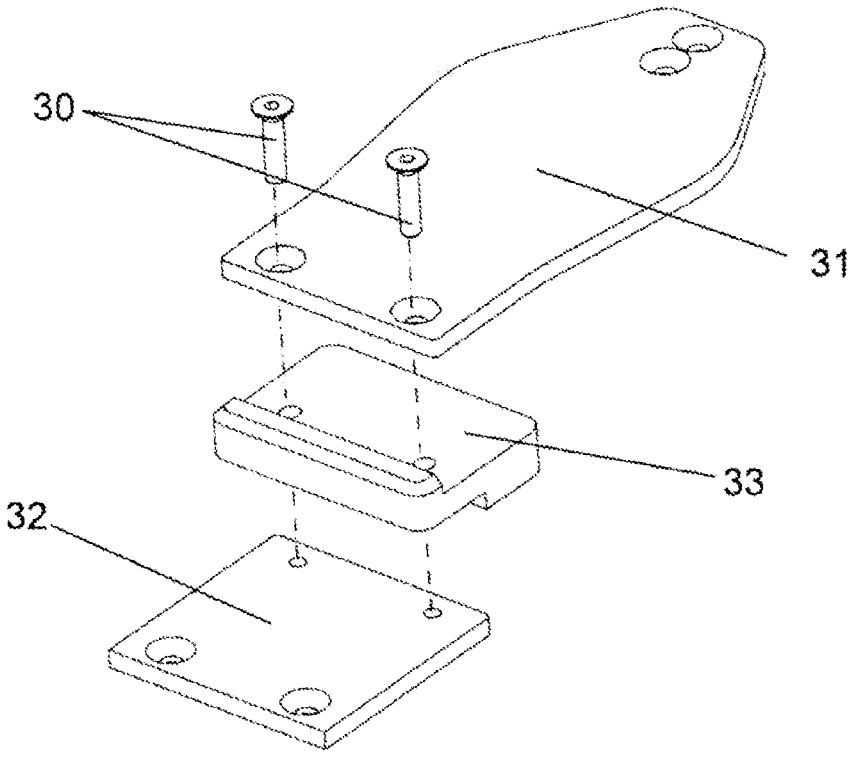
FIG. 8*c* shows an arrangement of FIG. 8*a* whereby the striking block can be reversed to provide an alternative striking position and or striking block form factor.

FIG. 8*c* shows the an alternative embodiment of the footboard components described in FIG. 8*a* whereby the fixings 30 can be temporarily removed while the striking block 33 is flipped longitudinally in the assembly between the upper footplate 31 and lower footplate 32 to provide an extended step in the footboard assembly. Extending the step in effect moves the heel striking point further down the footboard and closer to the footboard pivot pin. Locating the heel striking point closer to the footboard pivot pin has the effects as described in FIG. 4*b*. The two striking surfaces of striking block 33 can be manufactured with a different profiles, finish and or material to offer the drummer a choice of playing surfaces and form factors.

Figure 9A:
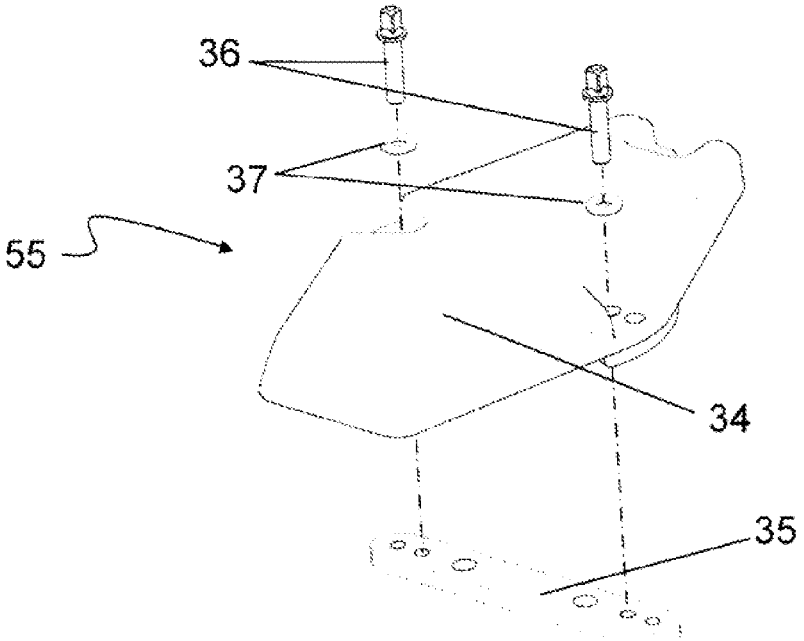
FIGS. 9*a* and 9*b* show an alternative arrangement of the invention whereby an attachment is used to convert an existing drum pedal with a flat footplate into a joggled or stepped profile by effectively raising the upper portion of the pedal's footplate.
Figure 9B:
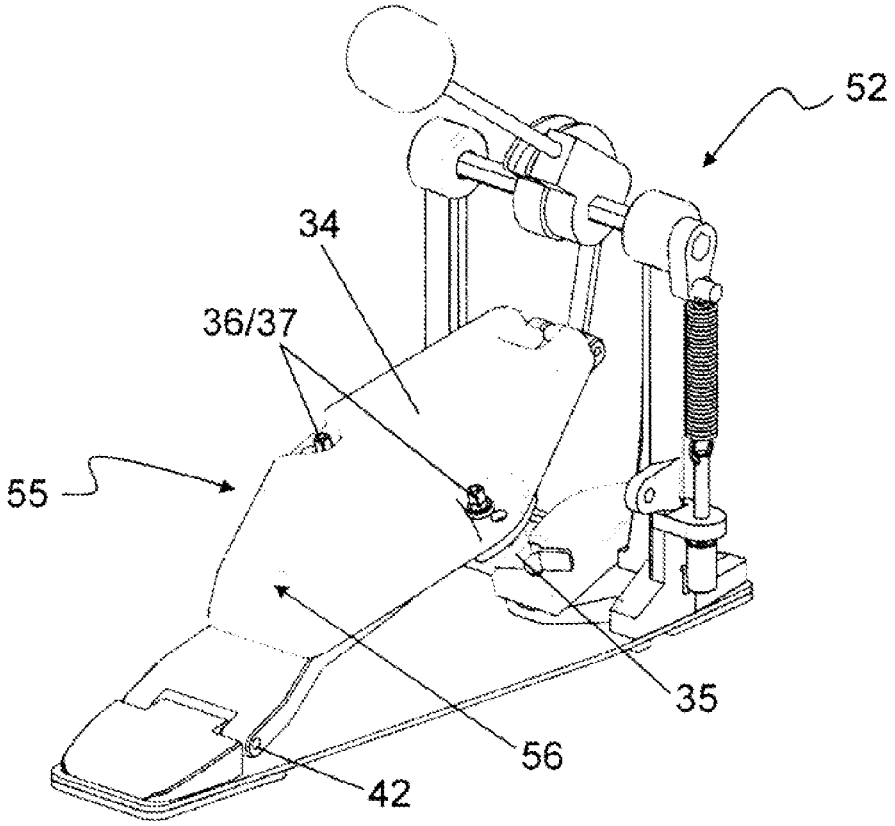

FIGS. 9*a* and 9*b* show an alternative embodiment of the invention whereby an attachment 55 is used to convert an existing drum pedal with a flat footplate as described in FIG. AA into a joggled or stepped footplate assembly by effectively raising the upper portion of the pedal's footplate. FIG. 9*a* shows details of said attachment which comprises a platform 34 used to raise the upper portion of a standard flat footplate and provide a stepped heel striking area, a threaded clamping bar 35, fixings 36 and washers 37 being used to clamp the platform to the upper portion of the pedal's footplate.

FIG. 9*b* shows the attachment 55 as described in FIG. 9*a* clamped in position on a standard flat footboard pedal 52, the flat footboard being clamped between the platform 34 and the threaded clamping bar 35. The step in the footboard playing surface that has been created by adding the attachment 55 creates a heel striking area 56. The location of the heel striking area in relation to the pedal's pivot pin 42 can be adjusted by slackening the fixings 36, sliding the attachment 55 up or down the pedal's footplate and tightening the fixings to secure the attachment in the desired position. Positioning the striking area 56 closer and further away from the footboard pivot pin 42 have the effects as described in FIGS. 4*a* and 4*b*. Further striking areas of differing profiles and surface finishes and or materials can be manufactured into each end of platform 34 so that the attachment can be removed and rotated and or flipped and re-attached to offer the drummer a plurality of playing surface and form factor options.

Figure 10:
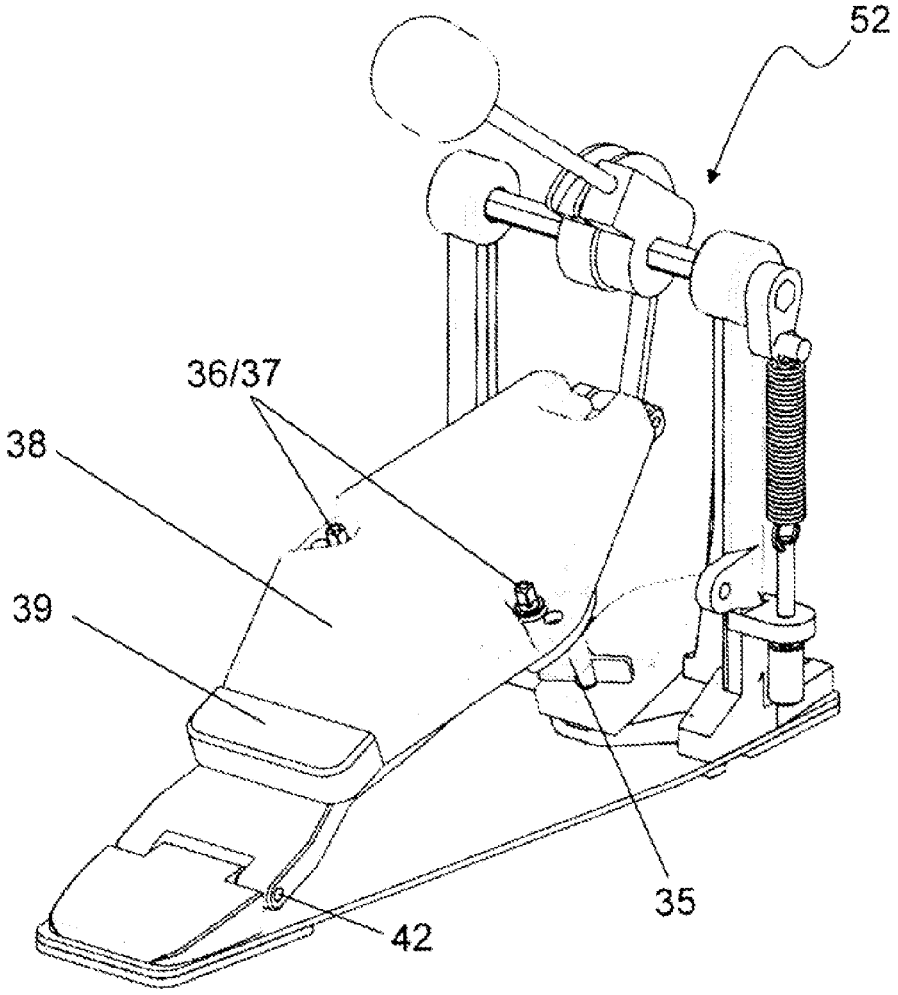
FIG. 10 shows an alternative arrangement of the invention whereby an attachment with a reversible and replaceable striking block is used to convert an existing drum pedal with a flat footplate into a joggled or stepped profile by effectively raising the upper portion of the pedal's footplate.

FIG. 10 shows an alternative embodiment of the attachment described in FIGS. 9*a* and 9*b* whereby the platform 38 is fitted with an additional striking block 39, the striking block being reversible and replaceable to offer the drummer a choice of playing surfaces and form factors.

Figure 11:
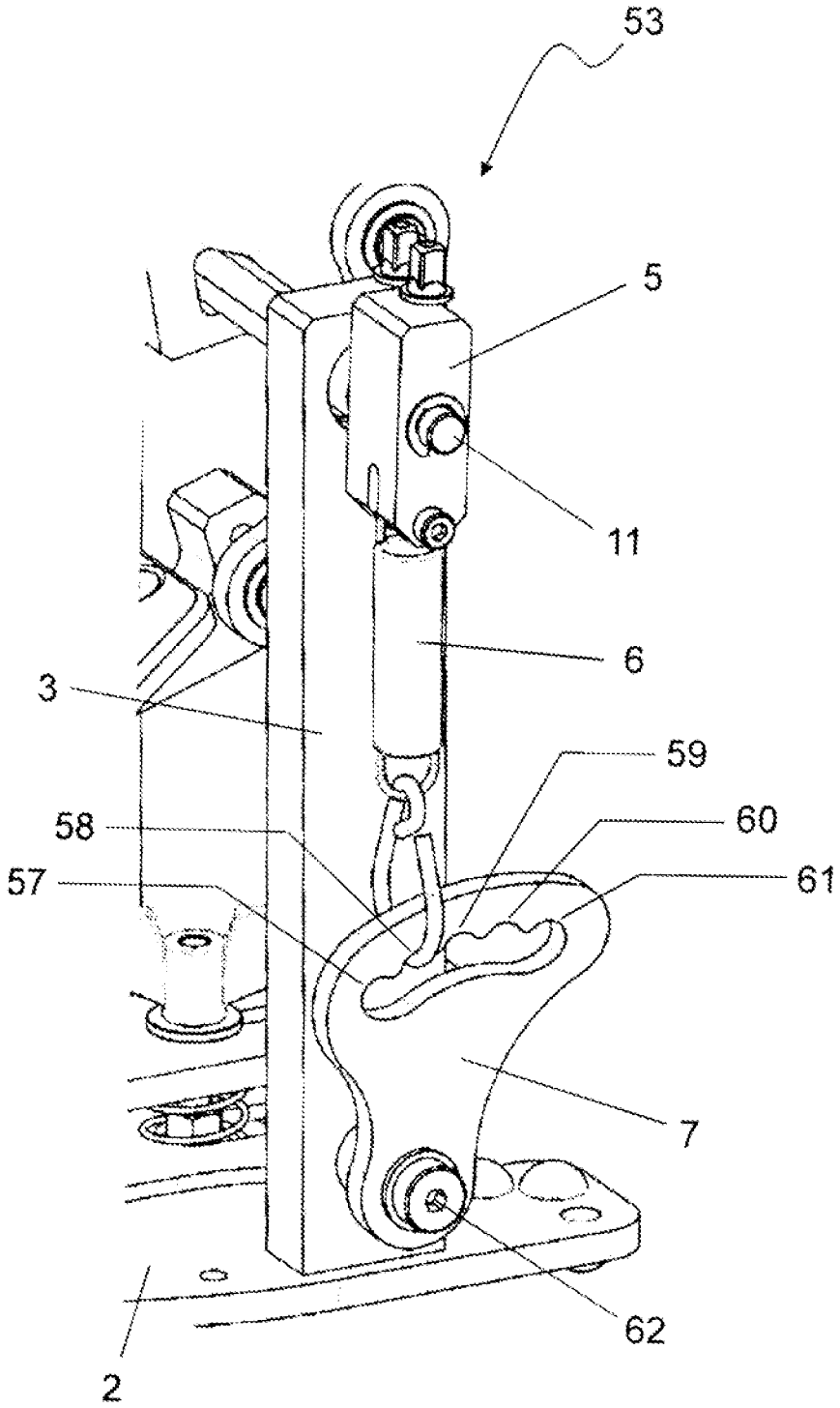
FIG. 11 shows further detail of the tension mechanism shown in FIG. 1.

FIG. 11 shows further details of the tension mechanism shown in FIG. 1 whereby one end of the extension spring is attached to tension cam 5 and the other end of the extension spring is attached to a profiled slot in cam plate 7, whereby said cam plate is fixed to the base plate 2 or front frame 3 by means of a pin 62 on which said cam plate is allowed to pivot in such an arrangement as to put the extension spring under tension. The upper edge of the profiled slot in said cam plate forms a plurality of indexing notches 57, 58, 59, 60 and 61, into which the extension spring can hook onto, whereby the distance between each said indexing notch and pin 62 differ so that when said cam plate is rotated about said pin different indexing notches are selected producing different tensions on the extension spring. The number of indexing notches and their position in relation to each other and the pin are shown here purely by example only.

Figure 12:
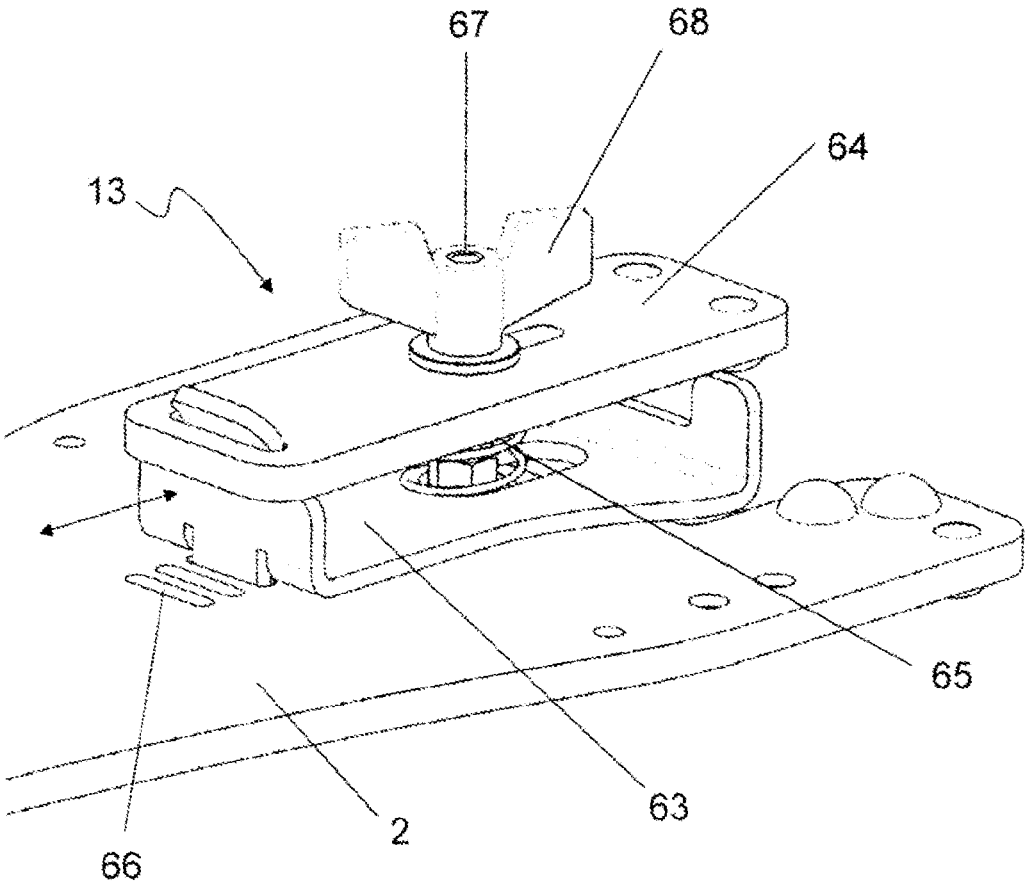
FIG. 12 shows further details of the clamp mechanism shown in FIG. 1.

FIG. 12 shows further details of clamp 13 shown in FIG. 1. The clamp, used to attach the drum pedal to the rim or hoop of a drum comprises, a threaded fixing 67 attached to the base plate 2, a back-stop 63 that slots over said threaded fixing and an upper jaw 64 that also slots over said threaded fixing in such an arrangement that said upper jaw is allowed to rest and pivot on the back edge of said back-stop. A spring 65 spaces said upper jaw from said back-stop such that a wing nut 68 or similar when turned on said threaded fixing, pivots said upper jaw against said back-stop creating a clamping action between said upper jaw and said base plate. A tab in said back-stop locates into one or more of a plurality of holes or indexing slots 66 in said base plate, whereby said back-stop is held in place only under the compression force of said spring in such an arrangement that said back-stop can be manually lifted out of said indexing slot and moved forwards and backwards in the direction of the unlabelled arrow such that the tab in said back-stop may be located into another indexing slot thus altering the position of the clamp on the drum pedal without the use of tools.

The invention claimed is:

1. A footplate for a drum pedal, the footplate comprising a forefoot contact-receiving portion, a heel contact-receiving portion and a fulcrum therebetween about which a user's foot may pivot between contacting respectively the heel and forefoot contact-receiving portions.

2. A footplate as claimed in claim 1, whereby successive applications of force on the heel contact-receiving portion and forefoot contact-receiving portions are capable of causing successive propulsions of a drum beater configured therewith.

3. A footplate as claimed in claim 1, which is configured for pivotal mounting relative a baseplate of a drum pedal at an aft portion of the footplate and which is configured for engagement with a drive mechanism for driving propulsion of a drum beater, whereby application of a force against the heel and/or forefoot contact-receiving portion may cause pivotal movement of the footplate about the pivotal mounting and may cause the drive mechanism to effect propulsion of the drum beater.

4. A footplate as claimed in any one of claims 1, whereby a sole of a user's footwear may pivot about the fulcrum to effect two discrete applications of force on respectively the heel contact-receiving portion and the forefoot contact-receiving portion whereby at least two discrete depressions of the footplate may be effected.

5. A footplate as claimed in claim 1, wherein the heel contact-receiving portion comprises the aftmost surface of the fulcrum and a void is provided aft of the fulcrum to allow effective contact of a user's heel with the heel contacting portion.

6. A footplate as claimed in claim 5, wherein the void is provided by the provision of an aft portion of the footplate having a substantially planar surface defining a plane that is perpendicularly offset from a plane defined by a substantially planar surface of a fore portion of the footplate.

7. A footplate as claimed in claim 1, wherein the fulcrum is provided by a joggle or step formed in the footplate between a fore portion comprising the forefoot contact receiving portion and an aft portion.

8. A footplate as claimed in claim 7, wherein the joggle or step is pre-formed and fixed in position.

9. A footplate as claimed in 1, wherein the fulcrum is provided by an adjustable block attached to a surface of the footplate, which adjustable block provides an elevated heel contact-receiving portion relative an aftmore portion of the footplate.

10. A footplate as claimed in claim 9, wherein the adjustable block is adjustable along a length of the surface of the footplate whereby the relative mechanical advantage achievable via the forefoot and heel contact-receiving portions may be varied.

11. A footplate as claimed in claim 9, wherein a step or joggle is provided in the footplate in association with or to the fore of the adjustable block whereby the fore portion of the footplate comprising the forefoot contact-receiving surface defines a plane elevated relative the aft portion of the footplate.

12. A footplate as claimed in claim 1, which comprises a fore portion which defines a plane perpendicularly offset from a plane defined by an aft portion, wherein a moveable platform is provided for moving between an engaged position in which it is positioned on or above the aft portion of the footplate and upon which a users heel may rest and thereby reducing or neutralising the offset in elevation between the fore and aft portions and a disengaged position in which the platform is not positioned on or above the aft portion.

13. A drum pedal assembly comprising:

a base plate having mounted thereon a front frame for supporting a drum beater and drive axel and a drum beater supported by the front frame;

a footplate pivotally mounted to the base plate at an aft portion of the footplate; and a drive mechanism configured with a fore portion of the footplate and the drum beater so that application of a force against footplate causes pivotal movement of the footplate about the pivotal mounting and causes the drive mechanism to effect propulsion of the drum beater, characterised in that the footplate is as defined in claim 1.

14. A drum pedal assembly as claimed in claim 13, wherein the footplate is pivotally mounted to the base plate by means of a baseplate pivot and the footplate comprises a fulcrum disposed or formed thereon, wherein one or both of the baseplate pivot and the fulcrum are adjustable so as to vary the longitudinal distance between the baseplate pivot and the fulcrum.

15. A drum pedal assembly as claimed in claim 13, which comprises a means of clamping the pedal to a rim of a drum comprises a clamp located into one or more of a plurality of slot features in a base plate of the drum pedal held releasably in a laterally secure position by a spring, whereby without the use of tools, the clamp can be manually lifted, repositioned and relocated into adjacent said slot features, thus providing a plurality of laterally secure clamping positions

16. A drum pedal assembly as claimed in claim 13, which comprises a means of providing adjustable tension to a drive axel on which a beater is mounted is achieved through a pivoting cam plate, whereby said cam plate incorporates a profiled slot featuring a plurality of indexing notches into which an extension spring can hook onto, whereby the distance between each said indexing notch and said cam plate pivot differ so that when said cam plate is rotated about said pivot different indexing notches are selected producing different tensions on the extension spring.

17. A footplate attachment for a footplate for a drum pedal, the footplate attachment comprising a platform bound by at least one edge and a means of permanently or releasably affixing the attachment to a substantially planar footplate for a drum pedal, wherein in use attached to a footplate the platform provides a forefoot contact-receiving surface and the at least one edge, or a striking block provided on the platform, provides a fulcrum about which a user's foot may pivot.

18. A footplate attachment as claimed in claim 17, wherein in use attached to a fore portion of a footplate, the at least one edge, or striking block, configured at the aftmost part of the platform serves as the fulcrum whereby a user's foot may pivot between contacting respectively a heel contact-receiving portion and the forefoot contact-receiving portion.

19. A footplate attachment as claimed in claim 18, whereby in use successive applications of force on the heel contact-receiving portion and forefoot contact-receiving portions are capable of causing successive propulsions of a drum beater configured therewith.

20. A footplate attachment as claimed in claim 17, wherein the means for affixing the attachment to a footplate comprises a clamp arrangement for clamping the attachment to the footplate of a drum pedal or an adhering surface for adhering to the striking surface of a footplate.

* * * * *